US007703856B1

(12) United States Patent
Duncan

(10) Patent No.: US 7,703,856 B1
(45) Date of Patent: Apr. 27, 2010

(54) MANHOLE COVER FRAME REMOVAL SAW

(76) Inventor: C. Warren Duncan, 3305 W. Warner Ave., Santa Ana, CA (US) 92704

( * ) Notice: Subject to any disclaimer, the term of this patent is extended or adjusted under 35 U.S.C. 154(b) by 676 days.

(21) Appl. No.: 11/514,597

(22) Filed: Aug. 31, 2006

(51) Int. Cl.
*E21C 25/00* (2006.01)
*E01C 23/00* (2006.01)

(52) U.S. Cl. ..... 299/39.3; 299/39.9; 82/70.2; 83/54; 83/184; 83/745

(58) Field of Classification Search ..... 83/54, 83/178, 184–187, 195, 745; 30/92–94, 102, 30/103, 108, 417, 427, 429, 430, 433, 435–437, 30/440–442, 444, 448; 166/55.7; 29/557; 82/16, 70.2, 113; 299/36.1, 39.1, 39.3, 39.9, 299/40.1, 78; 404/25
See application file for complete search history.

(56) References Cited

U.S. PATENT DOCUMENTS

| | | | | | |
|---|---|---|---|---|---|
| 588,243 | A * | 8/1897 | Robbins | 30/433 |
| 1,002,068 | A * | 8/1911 | Martz | 30/433 |
| 1,115,277 | A * | 10/1914 | Bodkin | 30/97 |
| 1,153,137 | A * | 9/1915 | Shulz | 404/86 |
| 2,769,234 | A * | 11/1956 | Young | 30/97 |
| 3,649,071 | A * | 3/1972 | Graff | 299/41.1 |
| 3,650,514 | A * | 3/1972 | Stunkard | 266/56 |
| 3,807,047 | A * | 4/1974 | Sherer et al. | 30/97 |
| 3,957,386 | A * | 5/1976 | Lupke | 408/50 |
| 4,091,514 | A * | 5/1978 | Motes-Conners et al. | 29/33 T |
| 4,206,664 | A * | 6/1980 | Miyagawa | 82/113 |
| 4,662,607 | A | 5/1987 | Mochizuki et al. | |
| 4,789,072 | A | 12/1988 | Quam et al. | |
| 4,838,521 | A | 6/1989 | Moisan | |
| 4,924,951 | A * | 5/1990 | Paulson | 175/57 |
| 5,035,336 | A | 7/1991 | Schmitz et al. | |
| 5,261,150 | A * | 11/1993 | Grube et al. | 29/560 |
| 5,349,751 | A * | 9/1994 | Fahr | 30/102 |
| 5,382,131 | A | 1/1995 | Werthmann | |
| 5,470,131 | A * | 11/1995 | Nolan et al. | 299/41.1 |
| 5,522,646 | A * | 6/1996 | Friedman et al. | 299/39.3 |
| 6,131,557 | A * | 10/2000 | Watson | 125/13.01 |
| 6,164,898 | A | 12/2000 | Taylor | |
| 6,425,638 | B1 * | 7/2002 | Kodama | 299/39.3 |
| 6,536,987 | B2 * | 3/2003 | Chang | 404/25 |

(Continued)

FOREIGN PATENT DOCUMENTS

| | | |
|---|---|---|
| GB | 2 236 299 | 4/1991 |

*Primary Examiner*—Boyer D. Ashley
*Assistant Examiner*—Edward Landrum
(74) *Attorney, Agent, or Firm*—Stetina Brunda Garred & Brucker

(57) ABSTRACT

A manhole cover frame removal apparatus has a ring-shaped base with a circular track thereon and a saw mounting framework disposed atop the base. Rollers allow the saw mounting framework to advance in rotation about aligned vertical axes of the frame and the base. A saw mounting arm is joined to the framework and may be raised and lowered and locked in the raised position. A saw carriage is mounted on the saw arm for reciprocal movement toward and away from a saw arm hinge axis. A single saw motor is mounted on the carriage and can be immobilized at selected angles. Separate horizontal-cut and vertical-cut saw blades are alternatively and interchangeably attached to the saw blade rotor.

12 Claims, 8 Drawing Sheets

U.S. PATENT DOCUMENTS

| | | | | |
|---|---|---|---|---|
| 6,582,026 | B2 * | 6/2003 | Bertrand | 299/39.3 |
| 6,709,064 | B2 * | 3/2004 | Nettek | 299/39.3 |
| 7,494,191 | B1 * | 2/2009 | Crites | 299/41.1 |
| 2003/0235487 | A1 | 12/2003 | Roberts | |
| 2004/0042886 | A1 | 3/2004 | Roberts | |

* cited by examiner

MANHOLE COVER FRAME REMOVAL SAW

BACKGROUND OF THE INVENTION

1. Field of the Invention

The present application is an apparatus for freeing a manhole cover frame from pavement in which it is embedded and a method of removing the manhole cover frame from pavement.

2. Description of the Prior Art

Underground utilities, such as electrical cables, gas lines, and water lines are in widespread use and are often accessible by means of manholes that are comprised of manhole covers set in manhole frames which are embedded in pavement. Both the manhole covers and the manhole cover frames are heavy, rugged items that must withstand the very great weight of vehicles traveling over them.

From time to time it is necessary to remove from the pavement both the manhole cover and the embedded frame within which the manhole cover is set. Manhole cover systems have to be removed for a variety of reasons. For example, realignment of a road bed requires lifting of the manhole cover and frame. Sometimes it is necessary to upgrade manhole covers to provide lockable systems. These systems also require a new manhole cover frame, as well as a new cover. Sometimes it is necessary replace manhole systems with waterproof manhole covers and manhole cover frames.

In conventional practice there are heavy-duty devices designed to lift manhole covers from their frames. As difficult as this sometimes is, the removal of a manhole cover frame from the pavement in which it is set is even more difficult. Currently manhole cover frames are removed by utilizing a jackhammer that is worked about the periphery of the manhole cover frame to break up the pavement into which the frame is set. The breaking up of the pavement about the periphery of the manhole cover frame is slow, backbreaking work. Even worse, removal of the manhole cover system in this manner damages the foundation on which the frame sits. That is, by using a jackhammer to break up pavement about the periphery of a manhole cover frame, cracks are often formed in the pavement that later admit moisture and subject the surrounding pavement to subsequent degradation due to the damage to the pavement inflicted by the breaking up the pavement about the periphery of a manhole cover.

Damage to the pavement is unacceptable, as loads from heavy traffic must be transferred to the road base through the foundation provided by the pavement. For this reason, in conventional practice the material surrounding the frame has to be over excavated and built back up again before installing the replacement frame. This is all very laborious, expensive, and time consuming.

SUMMARY OF THE INVENTION

The present invention provides a novel, economical system that greatly facilitates the removal of a manhole cover frame set in pavement. According to the present invention it is unnecessary to break up the pavement surrounding a manhole cover frame in order to remove the manhole cover frame from the pavement. To the contrary, according to the present invention a manhole cover frame to be replaced is cut out of the pavement with saw blades that create a horizontal, radial cut into the pavement just beneath the frame, and a vertical, circular cut just beyond the periphery of the frame. The manhole cover frame can then be lifted out, together with the relatively small amount of the pavement material into which it has been set.

Furthermore, by removing the manhole cover frame by sawing it free from the pavement, rather than breaking up the pavement surrounding the manhole cover, the pavement and roadbed below and peripherally beyond the manhole cover frame that is removed remains largely undamaged. It is therefore possible to replace the manhole cover frame and embed the new frame in the cavity left in the pavement with glue without affecting the existing underlying and surrounding road foundation.

Manhole cover frame removal according to the present invention is far less arduous and can be performed much more quickly than conventional manhole cover frame removal techniques using a jackhammer. As a consequence, the disruption to traffic and commerce on the roadway is drastically reduced.

In one broad aspect the present invention is an apparatus for freeing an annular manhole cover frame having a vertical axis of alignment embedded in pavement from the pavement. The apparatus used to free the manhole cover frame from the pavement is comprised of a ring-shaped base with a plurality of releaseable anchoring fasteners, a saw mounting framework disposed atop the ring-shaped base, a saw mounting arm joined to the saw mounting framework, a saw arm locking mechanism, a saw carriage, a saw motor with a releaseable lock, and separate horizontal-cut and vertical-cut saw blades.

The ring-shaped base has at least one circular track defined thereon about its entire circumference. The plurality of releaseable anchoring fasteners are located at intervals about the circumference of the base. The releaseable anchoring fasteners immobilize the base relative to the manhole cover frame so that the base is supported atop the manhole cover frame in coaxial alignment therewith.

The saw mounting framework is disposed atop the ring-shaped base and has a plurality of track followers that engage the track. As a result the saw mounting framework is movable in rotation about the vertical axis of alignment of the manhole cover frame.

The saw mounting arm is joined to the saw mounting framework by a saw arm orientation hinge having an horizontal saw arm hinge axis. The saw arm locking mechanism is used to lock the saw mounting arm relative to the saw mounting framework when it is in a vertical orientation relative thereto. The saw carriage is mounted on the saw arm for reciprocal movement toward and away from the saw arm hinge axis.

The saw motor has a saw motor housing and a saw blade rotor. The saw blade rotor is mounted for rotation relative to the saw motor housing about a saw rotor axis. The releaseable saw motor lock is used to immobilize the saw motor housing relative to the saw carriage at alternative selected angles of orientation of the saw motor axis relative to the saw mounting arm. The separate horizontal-cut and vertical-cut saw blades alternatively and interchangeably are attached to the saw blade rotor.

Preferably the ring-shaped base defines both a radially inwardly facing circular inner track and a radially outwardly facing circular outer track. The saw mounting framework is provided with a plurality of sets of inner and outer track rollers that respectively engage and follow the inner and outer tracks in rolling engagement therewith.

To closely control the rotational movement of the saw mounting framework atop the ring-shaped base, a ring gear coaxial with the ring-shaped base is preferably formed about the entire perimeter of the ring-shaped base. Also, a framework advancement pinion is journeled to the saw mounting framework for rotation about a vertical axis. A framework drive mechanism is provided for rotating the framework advancement pinion to advance the framework for rotation about the vertical axis of alignment throughout the circumference of the ring-shaped base. The framework drive mechanism may be automated, but is preferably a manually operated framework advancement handwheel coupled to the framework advancement pinion.

The ring-shaped base is preferably provided with a plurality of anchoring flanges located at intervals about the circumference of the base and depending therefrom. The anchoring flanges are oriented to face an exposed surface of the annular manhole cover frame. The provision of anchoring flanges facilitates the coupling of the anchoring fasteners. The anchoring fasteners pass through the anchoring flanges on the ring-shaped base and are engaged in the manhole cover frame.

Preferably, a locking support is provided for the saw mounting arm for use in locking the saw mounting arm in a vertical orientation. For this purpose a pair of saw mounting arm supporting links are provided. Both of the saw arm supporting links have first ends hinged to each other and opposing second ends. The second end of one of the supporting links is hinged to the saw mounting framework remote from the saw arm orientation hinge. The second end of the other supporting link is hinged to the saw mounting arm remote from the saw arm orientation hinge. The saw mounting arm supporting links are movable in articulated fashion in rotation about horizontal axes relative to each other and relative to the saw mounting framework and the saw mounting arm. The saw mounting arm supporting links are collapsible alongside each other when the saw mounting arm is in a horizontal orientation. Alternatively, the saw mounting arm supporting links are extended from each other when the saw mounting arm is in a vertical orientation.

The saw arm locking mechanism may be comprised of a pair of support link hinge elements which may be latch plates located at the first ends of the saw mounting arm supporting links. Each latch plate has at least one supporting link latch pin opening through it. A supporting link latch pin is provided which is engageable in the supporting link latch pin openings to immobilize the saw mounting arm supporting links relative to each other when the saw mounting arm is in a vertical orientation.

To accurately control the position of the saw carriage on the saw mounting arm, a linearly extending toothed rack is preferably formed on one side of the saw mounting arm. Also, the saw carriage is equipped with a carriage pinion with teeth engaged in the rack, as well as a carriage pinion drive mechanism. The saw carriage is thereby engaged by rack and pinion gearing in its reciprocal movement along the saw mounting arm. While the carriage pinion drive mechanism may be power driven, preferably it is comprised of a manually operated carriage position control handwheel that is coupled to the carriage pinion.

The apparatus of the invention is preferably constructed so as to be adaptable to manhole cover frames having different outer diameters. Manhole cover supporting frames are typically configured in diameters sufficient to support manhole covers having diameters of twenty-four inches, thirty-two inches, forty-two inches, forty-five inches, and fifty inches. Therefore, in order for the apparatus of the invention to be capable of freeing annular manhole cover frames of different commercially available sizes it is necessary for the saw arm orientation hinge to be adjustably mounted on the saw mounting framework to vary the distance of the saw arm hinge axis from the vertical axis of manhole frame alignment. That is, the saw mounting arm is joined to the saw mounting framework at alternative locations thereon which differ in distance from the ring-shaped base. This variation in location of the saw mounting arm orientation hinge may be achieved by providing the saw mounting framework with a clevis mounting bracket for the saw mounting arm on the saw mounting framework.

The mounting bracket is comprised of a U-shaped metal shackle having a base or web rigidly attached to the saw mounting framework and a pair of mutually opposing arms projecting horizontally toward the ring-shaped base. Sets of holes are drilled at selected, horizontally separated locations on the shackle arms to receive the hinge pin for the saw arm orientation hinge. As a result, the distance of the saw arm orientation hinge outboard from the ring-shaped base may be increased to allow the manhole cover frame removal apparatus to accommodate larger manhole cover frames or decreased to allow it to accommodate smaller manhole cover frames.

One important aspect of the invention is the ability of the device to cut a circular, vertical groove completely around the periphery of the manhole cover frame. This would not be possible using a conventional circular saw blade since the progression of such a blade, mounted for rotation about a horizontal axis, would result in a multiplicity of short, linear grooves intersecting each other to form a polygonal pattern of cuts about the periphery of the frame.

However, according to the present invention, a vertical, completely circular groove can be cut about the entire perimeter of the manhole cover frame by utilizing a saw blade that has a frustoconical cutting periphery for the vertical cut. Preferably, the vertical-cut saw blade is mounted upon the saw blade rotor of the saw motor with the motor shaft directed inwardly toward the ring-shaped base and inclined downwardly at an angle to bring the lower, cutting periphery of the frustoconical saw blade into a vertical orientation.

This is achieved by mounting the saw blade so that the frustoconical cutting periphery thereof diverges away from the saw blade rotor. As a result, the cutting periphery of the frustoconical blade extends into the pavement in a circular arc, not a straight line. The blade is advanced around the periphery of the manhole cover frame by advancing the saw mounting framework in rotation about the vertical axis of alignment of the annular manhole cover frame upon the ring-shaped base. A complete, vertical, circular groove is thereby formed about the periphery of the manhole cover frame.

In another broad aspect the invention may be considered as an apparatus for cutting about the periphery of an annular manhole cover frame embedded in pavement. The apparatus is comprised of a horizontally oriented ring-shaped base having a plurality of anchor fasteners, a saw mounting framework, a saw mounting arm with a locking mechanism, a saw motor, and a vertical-cut saw blade having a frustoconical cutting periphery. At least one circular track is defined on the horizontally oriented ring-shaped base. The anchor fasteners attach the ring-shaped base at angularly offset locations to the annular manhole cover frame. The ring-shaped base is thereby supported atop the manhole cover frame and immobilized relative thereto.

The saw mounting framework is disposed atop the ring-shaped base and has a plurality of track followers engaged with the circular track. The saw mounting framework resides in a horizontal orientation and is movable in rotation relative to the ring-shaped base about its vertical axis.

The saw mounting arm is joined to the arm mounting framework and is positionable in an upright orientation. The saw mounting arm locking mechanism immobilizes the saw mounting arm relative to the saw mounting framework in this upright orientation.

The saw motor has a saw motor housing and a saw blade rotor. The vertical-cut saw blade is mounted on the saw blade rotor. The saw motor housing is secured in orientation relative to the saw mounting arm so that as the vertical-cut saw blade rotates about the rotor axis, a segment of the cutting periphery of the vertical-cut saw blade projects below the ring-shaped base to cut a vertical, circular groove in the pavement about the periphery of the manhole cover frame. This vertical, circular groove is created as the saw mounting framework is moved through one complete rotation relative to the ring-shaped base.

In still another broad aspect the present invention may be considered to be a method of freeing an annular manhole cover frame from pavement in which the manhole cover frame is embedded. According to the method of the invention a radial groove is cut radially outwardly into the pavement beneath the entire outer circumference of the manhole cover frame. A circular groove is cut downwardly into the pavement to a depth intersecting the radial groove about the entire outer circumference of the manhole cover frame. Thereafter the manhole cover frame is lifted vertically free from the pavement.

The invention may be described with greater clarity and particularity by reference to the accompanying drawings.

DESCRIPTION OF THE EMBODIMENT AND IMPLEMENTATION OF THE METHOD

Figure 1:
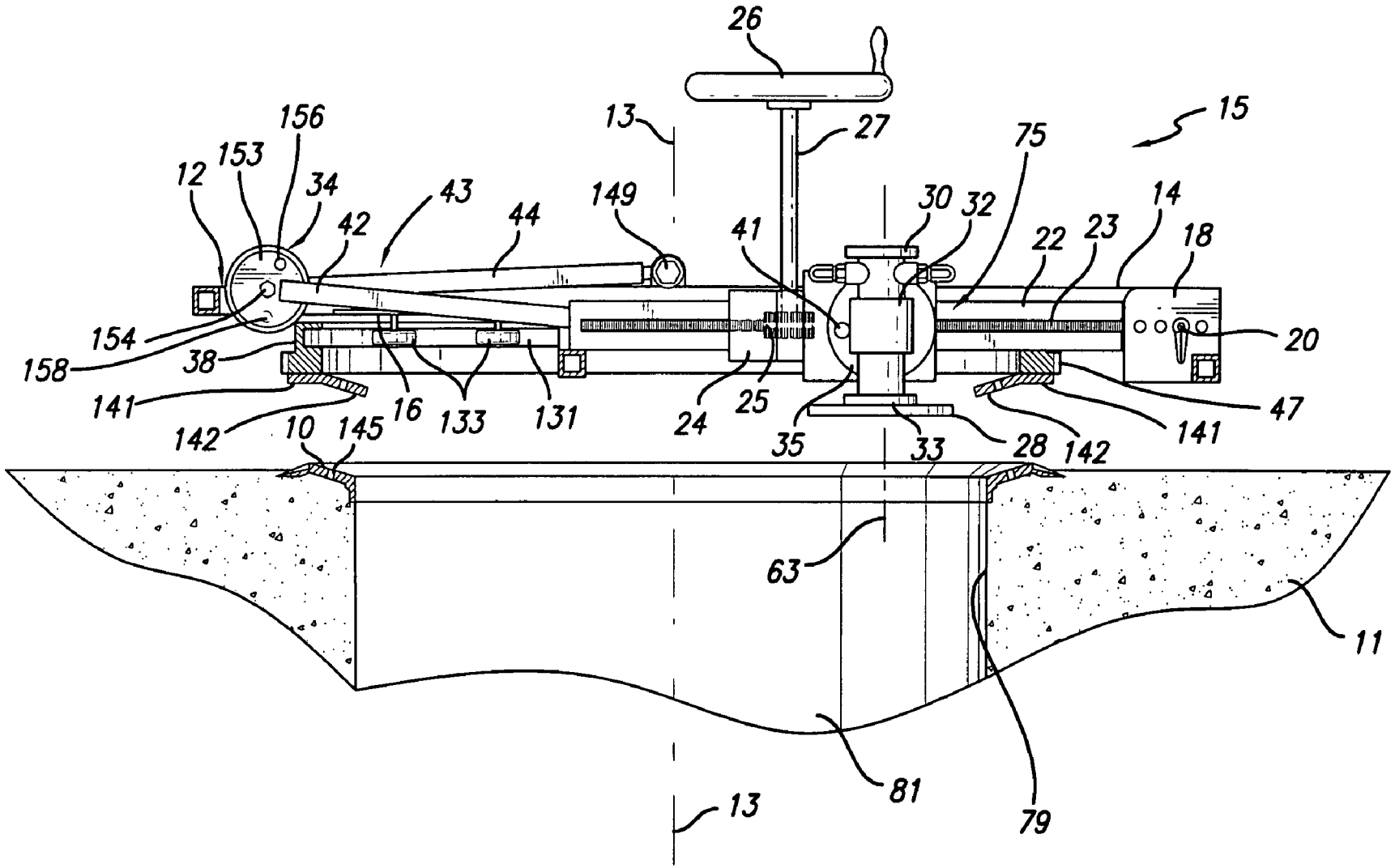
FIG. 1 is a side elevational sectional view illustrating a manhole cover frame removal apparatus according to the invention being lowered into position in preparation for freeing an annular manhole cover frame from pavement in which the frame is embedded.
Figure 2:
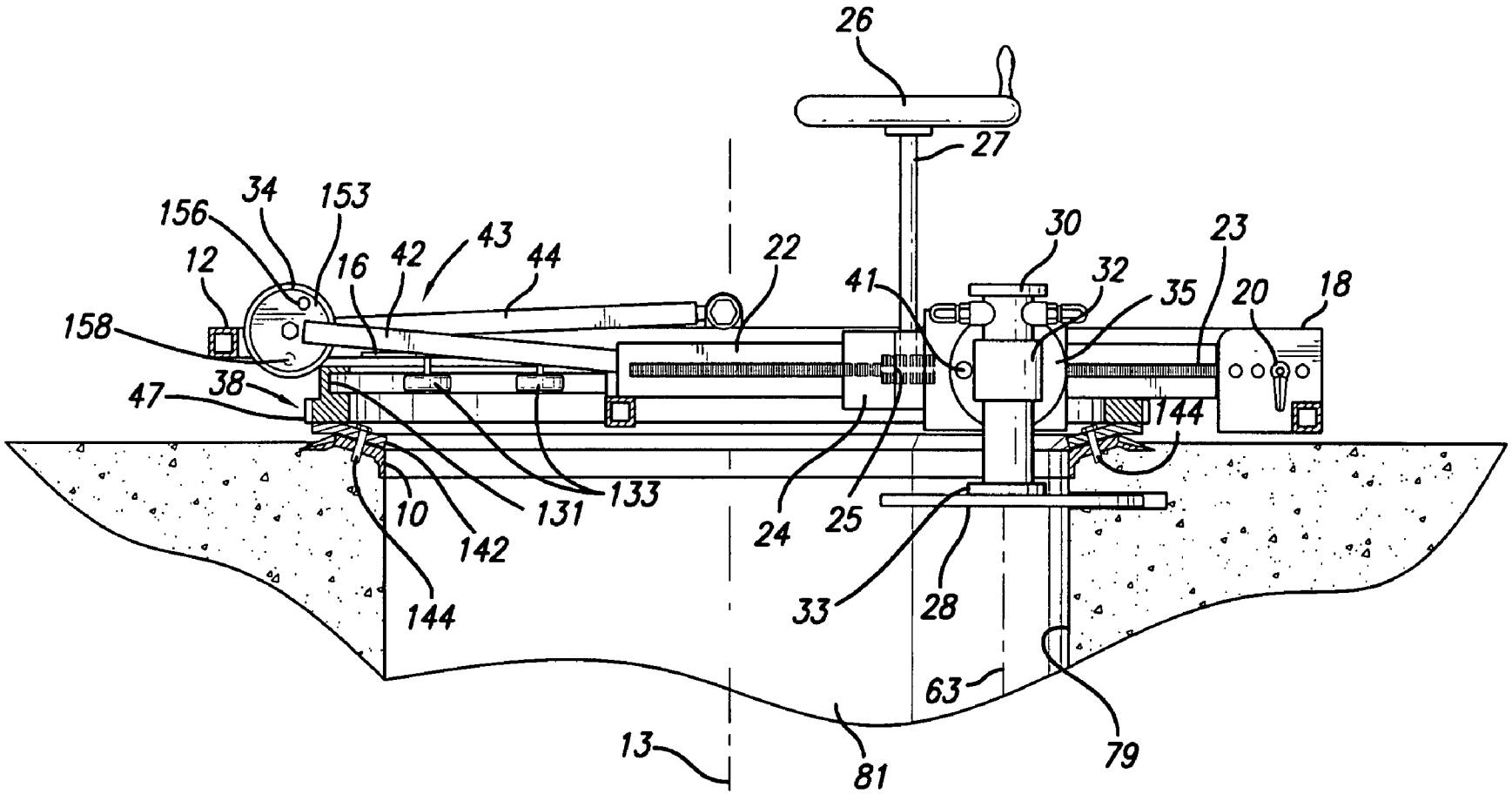
FIG. 2 is a sectional elevational view, partially broken away, showing the removal apparatus of FIG. 1 secured in position and operating to cut a horizontal groove into the pavement beneath the manhole cover frame.

FIGS. 1 and 2 illustrate, in cross section, an annular manhole cover frame 10 embedded in concrete pavement indicated at 11. The manhole cover frame 10 is typically formed of either steel or aluminum and has a diameter suitable for accommodating a generally disc-shaped manhole cover that may vary in size from as small as twenty-four inches up to as large as fifty inches. In some circumstances manhole covers of even smaller or larger diameters are used and are supported by manhole cover frames 10 of corresponding size. Whatever the size, the annular manhole cover frame 10 is oriented to reside in a generally horizontal disposition and has a nearly vertical axis of alignment, indicated at 13 in FIG. 1.

Figure 3:
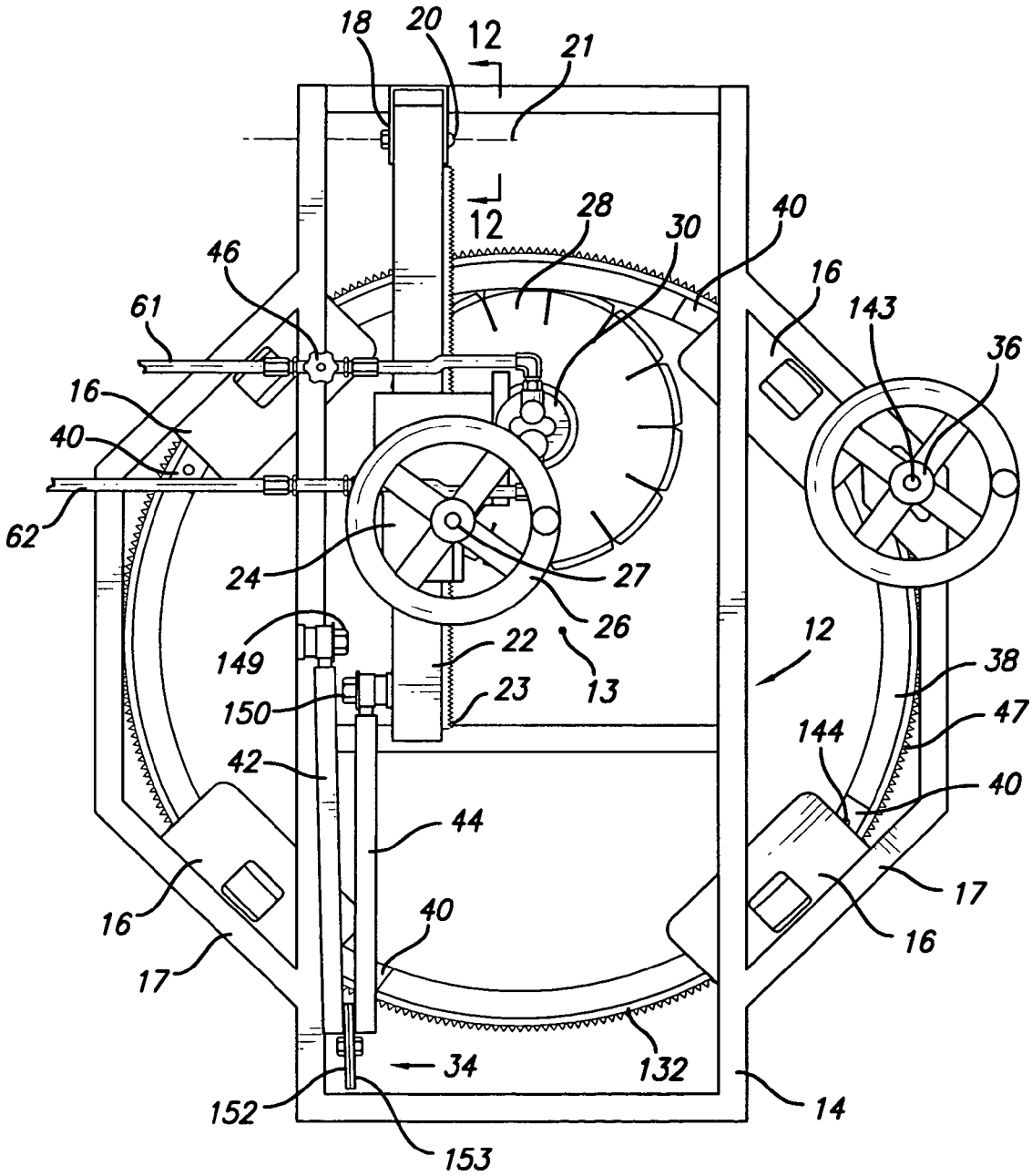
FIG. 3 is a top plan view of the removal apparatus of the invention shown as used for performing the horizontal cut.
Figure 4:
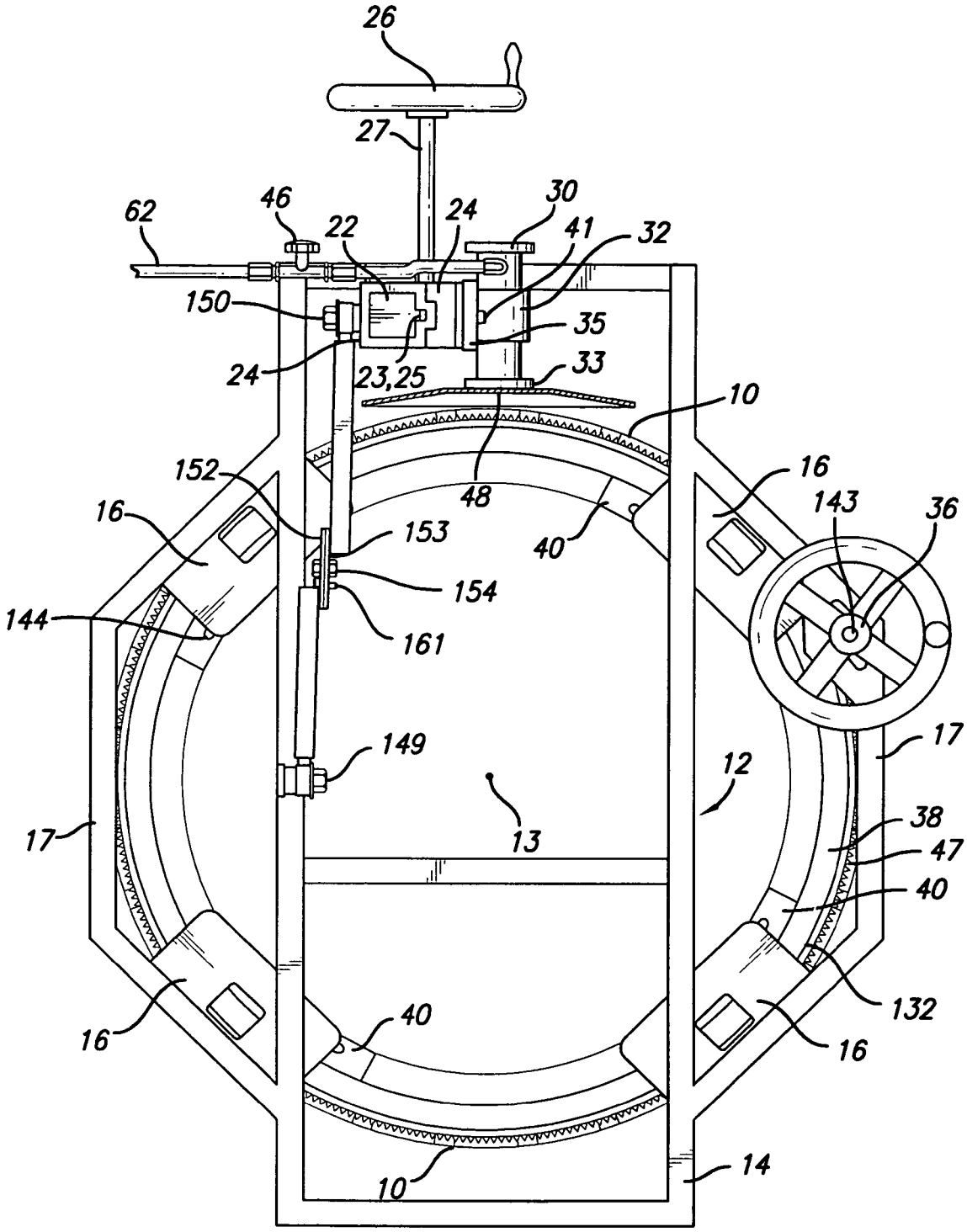
FIG. 4 is a top plan view of the removal apparatus of the invention shown as used for performing the vertical cut.

According to the invention a manhole cover frame removal apparatus 15 is provided for freeing the annular manhole cover frame 10 from the pavement 11. The manhole cover frame removal apparatus 15 is comprised of a ring-shaped base 38 having at least one, and preferably a pair of inner and outer circular tracks 131 and 132, shown in FIG. 8, defined thereon about its entire circumference. A plurality of releaseable anchoring fasteners 144 are provided and are located at intervals about the circumference of the base 38, as shown in FIGS. 2-4. The fasteners 144 immobilize the base 38 relative to the manhole cover frame 10 so that the base 38 is supported atop the manhole cover frame 10 in coaxial alignment therewith.

A saw mounting framework 12 is disposed atop the ring-shaped base 38 and has a plurality of track followers 133 and 135 that engage the tracks 131 and 132, respectively. The saw mounting framework 12 is movable in rotation about the axis 13 of the manhole cover frame 10.

Figure 5:
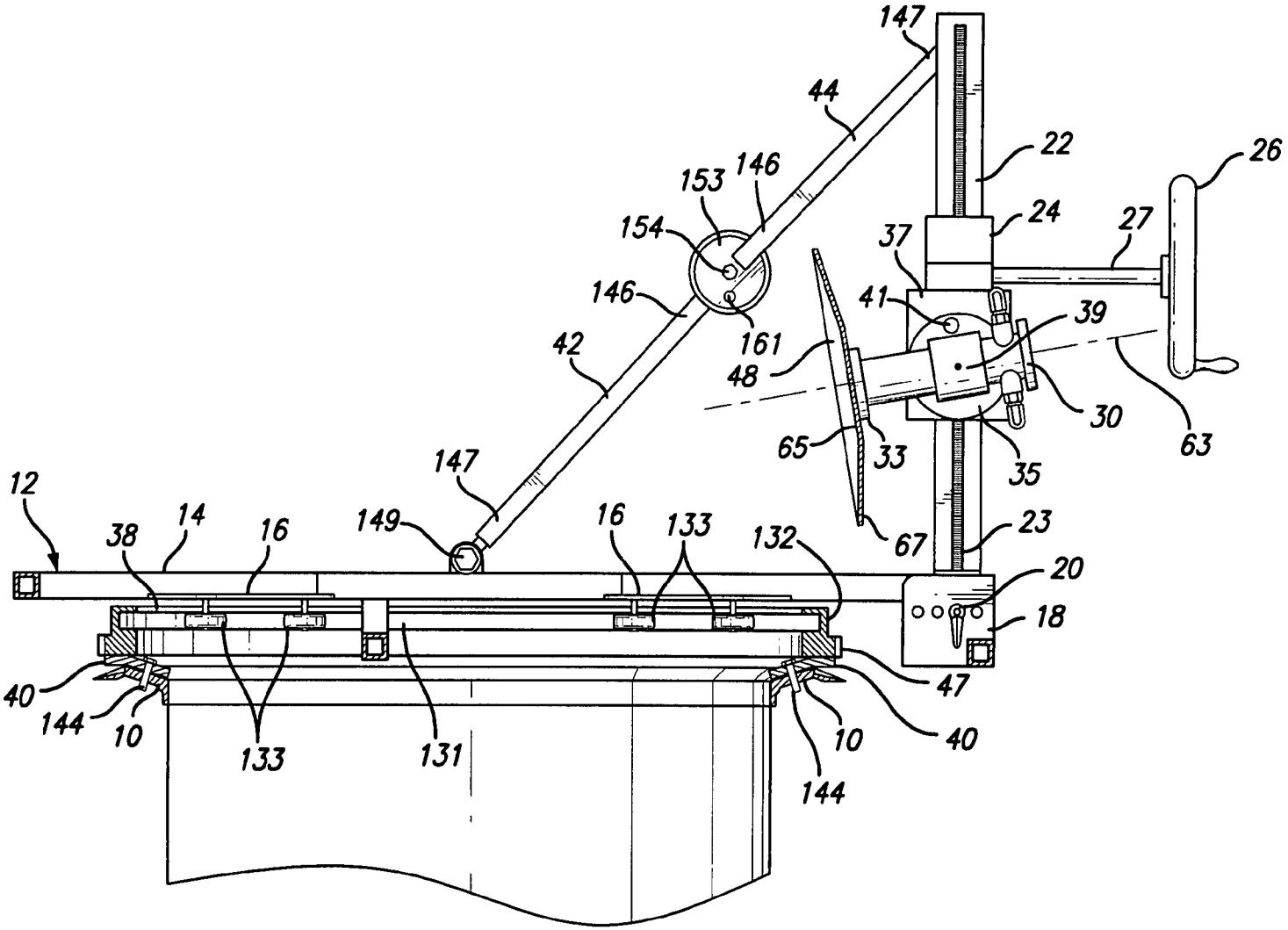
FIG. 5 is a sectional elevational view of the removal apparatus as shown in FIG. 4.
Figure 9:
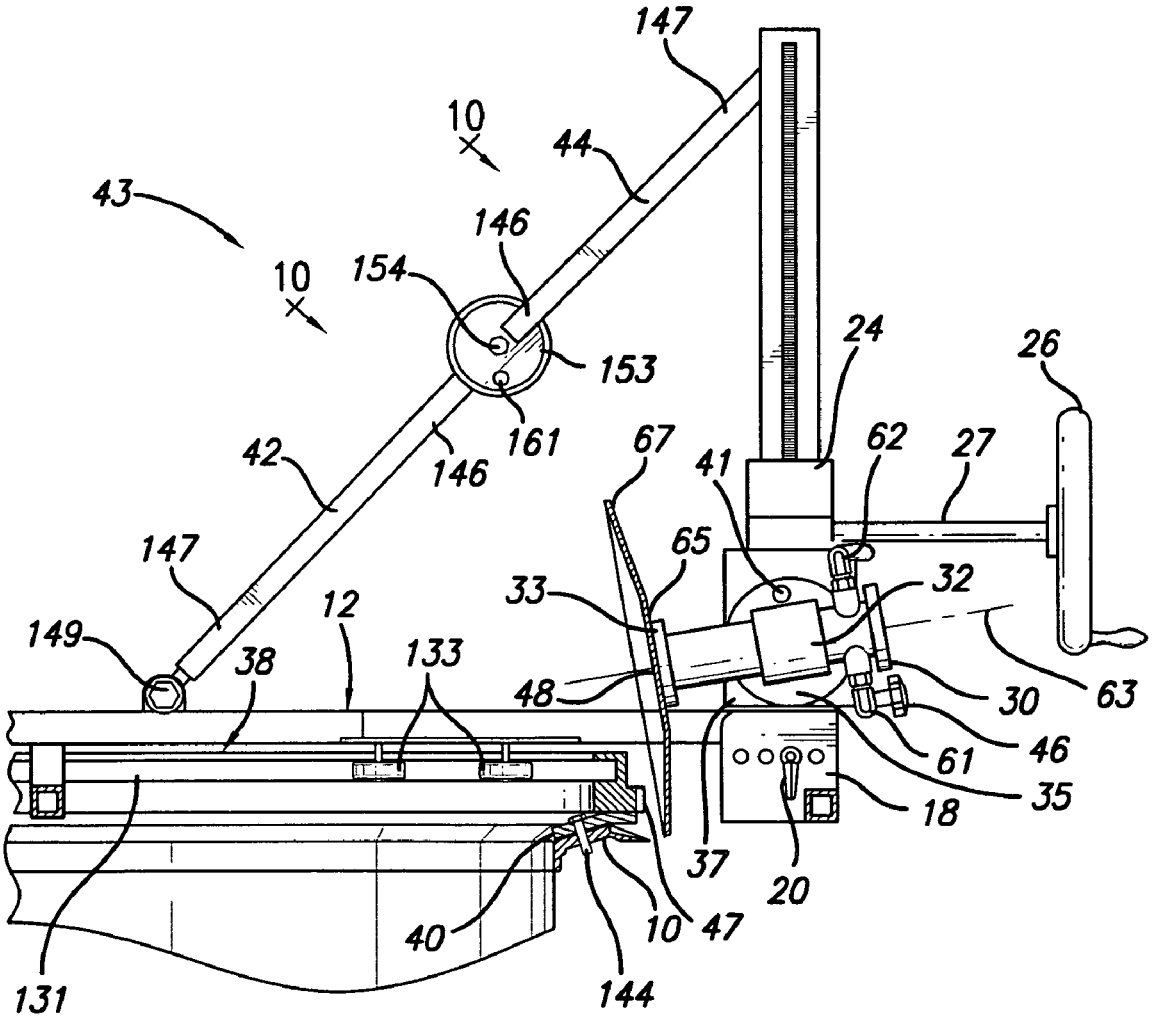
FIG. 9 is a side sectional elevational detail illustrating the saw mounting arm in an upright position and the vertical cutting blade mounted and lowered for cutting a vertical, circular ring about the periphery of the manhole cover frame.

A saw mounting arm 22 is joined to the saw mounting framework 12 by a saw arm orientation hinge 20 having a horizontal saw arm hinge axis 21. A saw arm locking mechanism is provided for locking the saw mounting arm 22 relative to the saw arm mounting framework 12 in a vertical orientation relative thereto, as illustrated in FIGS. 5 and 9. The saw arm locking mechanism is comprised of the hinge assembly 34 and the hinge locking pin 161.

A saw carriage 24 is mounted on the saw arm 22 for reciprocal movement toward and away from the saw arm hinge axis 21. A saw motor 30 having a saw motor housing 32 and a saw blade rotor 33 is mounted for rotation about a saw rotor axis 63 relative to the saw motor housing 32. A releaseable saw motor mount latch pin 41 is provided to serve as a releaseable lock for immobilizing the saw motor mount 35 and saw motor housing 32 relative to the saw carriage 24 at alternative, selected angles of orientation of the saw rotor axis 63 relative to the saw mounting arm 22.

A circular horizontal-cut saw blade 28 and a separate vertical-cut saw blade 48 are provided. The horizontal-cut saw blade 28 and the vertical-cut saw blade 48 are alternatively and interchangeably attached to the saw blade rotor 33.

The saw mounting framework 12 is disposed atop the ring-shaped base 38 for rotation about the vertical axis 13. The saw mounting framework 12 is comprised of a generally rectangular center frame 14, formed of hollow, two inch square steel tubing. The rectangular frame 14 should have dimensions suitable to the size of the manhole cover frame 10 to be removed. Typically, the rectangular frame 14 has a short side measurement of about three feet and a long side measurement of about five feet.

The saw mounting framework 12 is also comprised of a pair of side frames 17, also formed of hollow, two inch square steel tubing, that are welded to the long sides of the rectangular center frame 14 to form generally trapezoidal-shaped side extensions therefrom. The saw mounting framework 12 also includes four guide roller mounting plates 16 located on each of the inclined legs of the trapezoidal side extension frames 17 proximate their intersection with the rectangular frame 14.

The saw mounting framework 12 also includes a generally U-shaped shackle, which is a saw arm hinge mounting bracket 18 that is secured to one of the lengths of hollow tubing at one of the short ends of the rectangular frame 14. The saw mounting arm bracket 18 has a base or web that is welded to the saw mounting framework 12 and a pair of horizontally extending bracket arms. A plurality of sets of horizontally oriented apertures 19 are defined through both of the bracket arms at different distances from the ring-shaped base 38. The apertures 19 in the mounting bracket 18 are designed to alternatively accommodate the hinge axle of a saw arm orientation hinge assembly 20.

The transverse, horizontal axle of the saw arm orientation hinge assembly 20 has a horizontal saw arm hinge axis of rotation 21 and extends through a transverse, horizontal hinge axle opening in the base of the saw mounting arm 22. The saw mounting arm 22 is formed of hollow, four inch square steel tubing and has a length of about four feet. The hinge axle opening in the base of the saw mounting arm 22 receives the axle rod forming the axle of the saw arm orientation hinge assembly 20.

A linearly extending rack 23 of spur gear teeth is aligned longitudinally along the length of one side of the saw mounting arm 22 and is used to control the reciprocal movement of the saw carriage 24 along the length of the saw mounting arm 22. The position of the carriage 24 along the length of the saw mounting arm 24 is controlled by engagement of a carriage pinion 25, located and journeled within the structure of the carriage 24. The pinion 25 has spur gear teeth that are engaged with the spur gear teeth on the linear rack 23.

Rotation of the carriage pinion 25 is controlled by a manually operated carriage position control handwheel 26 which is connected to a shaft 27 that is journeled for rotation within the carriage 24 and to which the carriage pinion 25 is keyed. Rotation of the carriage position control handwheel 26 in one direction rotates the carriage pinion 25 to advance the carriage 24 toward the base of the saw mounting arm 22 that is rotatably supported in the mounting bracket 18. Rotation of the carriage position control handwheel 26 in the opposite direction drives the carriage 24 toward the opposite, distal end of the saw mounting arm 22, remote from the base of the saw mounting arm 22 that is hinged for rotation relative to the mounting bracket 18.

A saw motor 30 having a saw motor housing 32 and a saw blade rotor 33 is mounted to the carriage 24 by means of a disc-shaped motor mount 35 that resides in face to face disposition relative to the vertically oriented surface 37 of the carriage 24 opposite the linear gear rack 23. The motor mount 35 allows rotational adjustment of the orientation of the motor 30 about a horizontal axis of motor alignment 39. The orientation of the motor 30 relative to the carriage 24 and the saw mounting arm 22 can be releasably locked in position by a motor mount latching pin 41 that passes through a horizontal aperture in the motor mounting plate 35 and engages a selected one of several alternative bores in the carriage surface 37. The bores into the surface 37 are arranged in an arcuate pattern centered on the axis of motor alignment 39.

Figure 7:
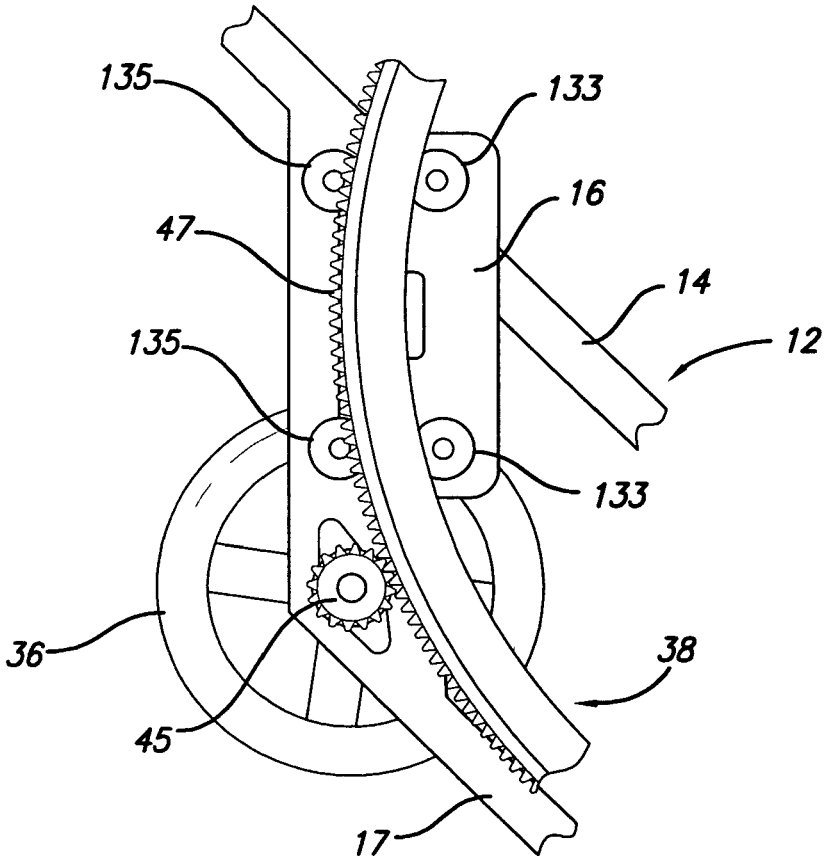
FIG. 7 is a bottom sectional plan detail illustrating from beneath the mounting of the saw mounting framework on the ring-shaped base.

The manhole cover frame removal apparatus 15 also has a manually operated framework advancement handwheel 36 that is connected by a shaft 143 to drive a framework advancement pinion 45, shown in FIG. 7. The framework advance pinion 45 is also equipped with spur gear teeth that are engaged with the corresponding spur gear teeth of a radially outwardly facing ring gear 47. The ring gear 47 is located on and extends about the entire circumference of the ring-shaped base 38.

The ring-shaped base 38 is provided with four anchor plates 40 that are spaced at equal, angularly offset intervals about the circumference of the ring-shaped base 38. The anchoring plates 40 have horizontally disposed flanges 141 that are welded to the underside of the ring-shaped base 38, and radially inwardly extending and downwardly inclined flanges 142 that are configured to reside in face to face relationship with the inclined surface 243 of a conventional manhole cover frame 10, as illustrated in FIG. 6.

Each of the anchoring plates 40 is provided with a releaseable fastener 144, which may be a bolt that has a shank engaged in an aperture 145 previously drilled into an exposed face of the manhole cover frame 10. When the releaseable anchoring bolts 144 are engaged in the apertures 145 in the manhole cover frame 10, the ring-shaped base 38 is securely, but releasably, immobilized relative to the manhole cover frame 10.

Figure 6:
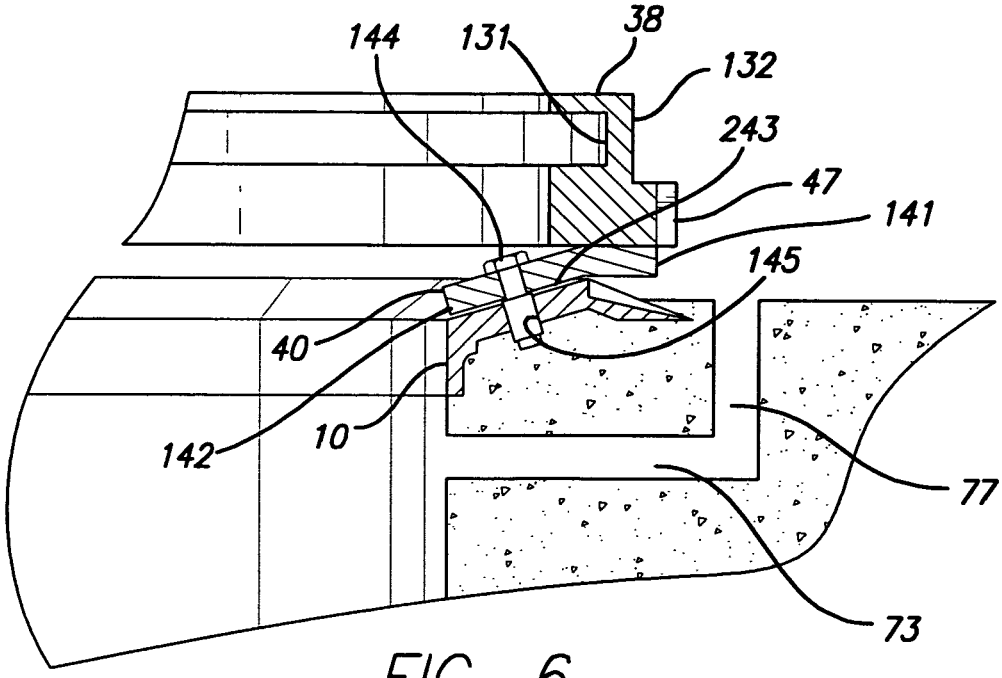
FIG. 6 is a sectional elevational detail view illustrating the attachment of the apparatus of the invention to the manhole cover frame and showing both the horizontal and vertical cuts created to free the manhole cover frame from the concrete in which it was embedded.

FIG. 1 illustrates the manhole cover removal apparatus 15 detached from the manhole cover frame 10, while FIGS. 2, 5, and 6 illustrated the manhole cover removal apparatus 15 when the ring-shaped base 38 thereof is securely anchored to the manhole cover frame 10. The anchoring bolts 144 are aligned with the drilled apertures 145 in the manhole cover frame 10 so that the ring-shaped base 38 is coaxially aligned with the manhole cover frame 10 about the common vertical axis of alignment 13.

The ring-shaped base 38 is provided with at least one, and preferably a pair, of vertically oriented circular tracks 131 and 132 which extend about the entire circumference of the ring-shaped base 38. The radially inner circular track 131 is defined as a radially inwardly facing channel in the inner surface of the ring-shaped base 38, while the radial outer track 132 is formed by the narrow, cylindrical wall structure of the ring-shaped base 38 just above the ring gear 47 that is disposed on the outer periphery of the ring-shaped base 38.

Figure 8:
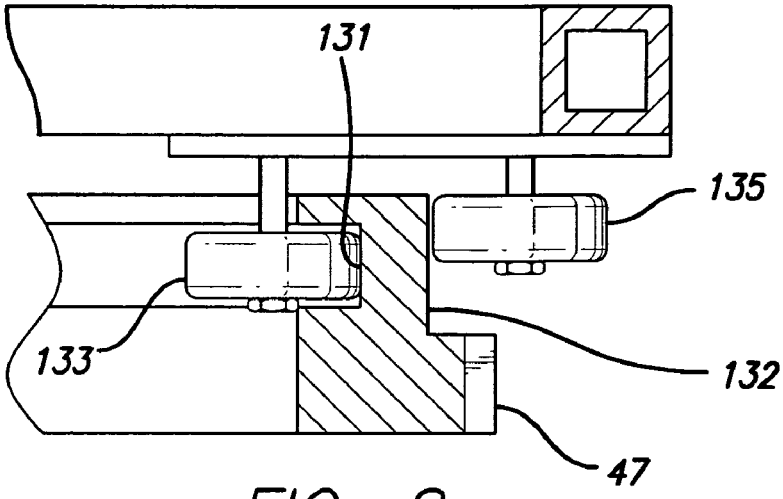
FIG. 8 is a side sectional elevational detail also illustrating the mounting of the saw mounting framework atop the ring-shaped base.

As illustrated in FIG. 7, each of the roller guide support plates 16 is provided with a pair of inside track follower rollers 133 and a pair of outside track follower rollers 135 that depend from and are mounted for rotation relative to the roller guide support plates 16. The track follower rollers 133 reside in rolling engagement with the radial inner track 131, while the radial outer track follower rollers 135 reside in rolling engagement with the radial outer track 132, as illustrated in FIGS. 7 and 8. The engagement of the rollers 133 and 135, which are ultimately mounted to the saw mounting framework 12, allow the saw mounting framework 12 to turn in rotation about the vertical axis of alignment 13 of the manhole cover frame 10 and relative to the ring-shaped base 38. The engagement between the rollers 133 and 135 with the tracks 131 and 132, respectively, ensures that the horizontally oriented axle pin of the saw arm orientation hinge assembly 20 travels in a circular path about the circumference of the ring-shaped base 38, centered in rotation on the axis of alignment 13, during both the horizontal cut performed with the circular horizontal-cut saw blade 28 and the vertical cut performed with the saw blade 48.

The framework advancement pinion 45 is journeled relative to the saw mounting framework 12 for rotation about the vertical axis of the vertical shaft 143. The framework drive handwheel 36 is used to rotate the shaft 143 to which the framework advancement pinion 45 is keyed to advance the framework 12 for rotation about the axis of alignment 13 throughout the entire circumference of the ring-shaped base 38.

The manhole cover frame removal apparatus 15 is also provided with a saw mounting arm support 43 formed with a pair of saw mounting arm supporting links 42 and 44. Both of the mounting arm supporting links 42 and 44 have first ends 146 which are hinged to each other and second ends 147. The second end 147 of the support link 42 is hinged to the saw mounting framework 12 for rotation about a horizontally oriented hinge pin 149. The second end of the mounting arm supporting link 44 is hinged to the saw mounting arm 22 remote from the saw arm orientation hinge 20 for rotation relative thereto on a horizontally oriented hinge pin 150.

The saw arm support 43 is provided with a saw arm hinge and locking mechanism 34 for releasably locking the saw mounting arm 22 in a vertical orientation relative to the saw mounting framework 12. The saw arm hinge and locking mechanism 34 is illustrated in detail in FIG. 10. The saw arm hinge and locking mechanism 34 is formed by a pair of vertically oriented, disc-shaped plates 152 and 153 which are disposed in congruent, face to face alignment and coupled together by an axial hinge assembly 154. Unless restrained, the disc-shaped hinge plates 152 and 153 are freely rotatable relative to each other upon the hinge assembly 154.

Figure 10:
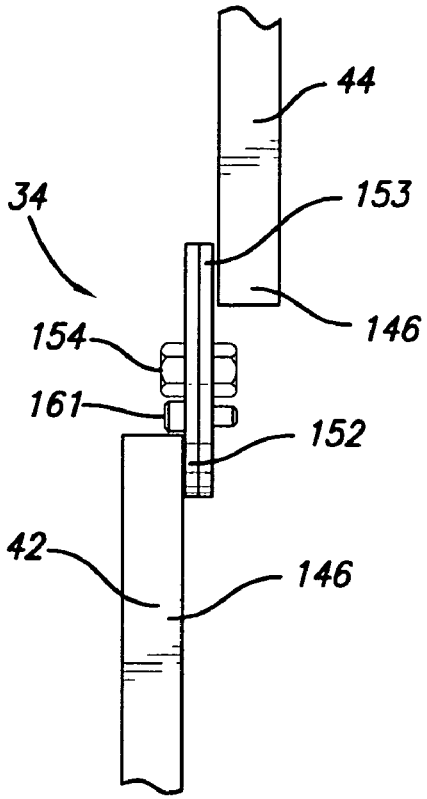
FIG. 10 is a detail taken along the lines 10-10 of FIG. 9.
Figure 11:
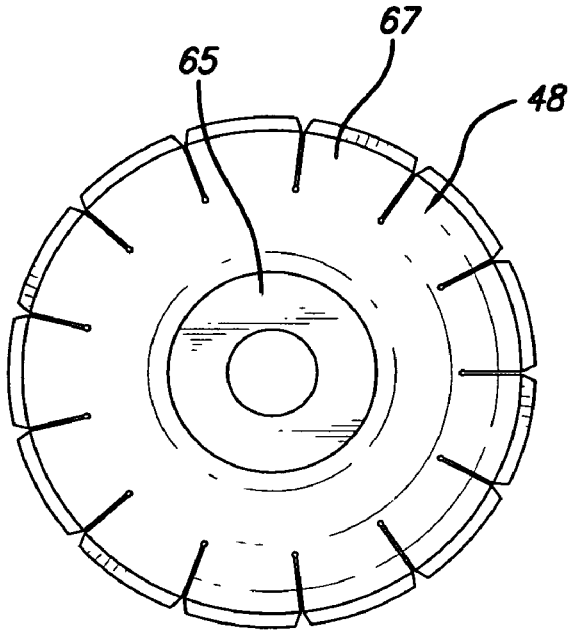
FIG. 11 is a top plan view of the saw blade for performing vertical cuts, shown in isolation.
Figure 12:
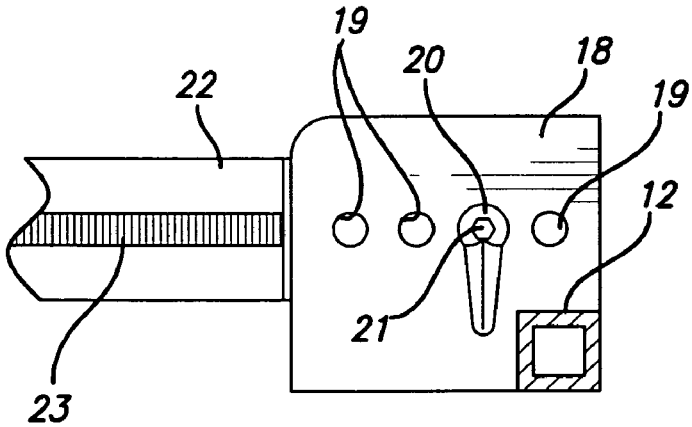
FIG. 12 is a sectional elevational detail taken along the lines 12-12 of FIG. 3.

The first end 146 of the saw mounting arm supporting link 42 is directed radially toward the hinge assembly 154 and welded to the outer, exposed surface of the hinge plate 152 in spaced separation from the hinge assembly 154, as illustrated in FIG. 10. Similarly, the first end 146 of the other mounting arm supporting link 44 is disposed in contact with and welded to the outer, exposed surface of the hinge plate 153 and is directed radially toward the hinge assembly 154.

As shown in FIG. 2, an aperture 156 is defined through the hinge plate 153 about one inch froth the outer diameter thereof, while a corresponding aperture 158 is defined through the hinge plate 152. The saw mounting arm supporting links 42 and 44 may be collapsed closely adjacent to each other with the hinge assembly 34 resting upon the saw mounting framework 12, as illustrated in FIGS. 2 and 3. When the saw mounting arm supporting links 42 and 44 are collapsed in this condition, the apertures 156 and 158, defined through the hinge plates 153 and 152, respectively, are angularly offset from each other nearly one hundred eighty degrees. When the mounting arm support 43 is collapsed in this fashion, the motor mount 35 is oriented and the motor mount latching pin 41 is engaged so that the rotor axis of rotation 63 is vertically aligned, as illustrated in FIGS. 2 and 3.

Alternatively, the saw mounting arm 22 may be raised to an upright, vertical orientation, as illustrated in FIG. 9. When the saw mounting arm 22 is raised to this condition, the mounting arm supporting links 42 and 44 are extended in opposite directions from each other. As the mounting arm supporting links 42 and 44 move in articulated rotation, the hinge plates 152 and 153 are rotated so that the apertures 156 and 158 ultimately reside in mutually coaxial alignment with each other. The saw mounting arm 22 can be locked in a vertical, upright orientation by inserting a saw mounting arm orientation locking pin 161 through the coaxially aligned apertures 156 and 158 in the hinge plates 153 and 152, as illustrated in FIGS. 4 and 9. With the hinge plates 152 and 153 immobilized relative to each other by the locking pin 161, the mounting arm supporting links 42 and 44 are likewise immobilized relative to each other, and extended apart as illustrated in FIG. 9 to hold the saw mounting arm 22 rigidly in an upright, vertical orientation.

The motor 30 is a conventional hydraulic motor powered by hydraulic fluid traveling through an inlet line 61 and exiting through an outlet line 62, both of which are visible in FIG. 3. A valve 46 in the inlet line regulates the flow of hydraulic fluid through the motor 30 to control the speed of rotation of the rotor 33.

FIG. 2 illustrates the operation of the manhole cover frame removal apparatus 15 making a horizontal cut beneath the manhole cover frame 10 using a circular saw blade 28. As illustrated in FIG. 2 the rotor 33 is oriented to drive the saw blade 28 in rotation about the rotor axis of rotation 63 which is in vertical alignment, parallel to the vertical axis of alignment 13 of the manhole cover 10 during the horizontal cut. As the rotor 33 drives the circular saw blade 28 in rotation, the handwheel 36 is operated to advance the saw mounting framework 12 to turn it in a complete circle about the ring-shaped base 38. The vertically oriented rotor axis of rotation 63 is moved orbitally in a complete circle about the vertical axis of alignment 13.

When the vertical cut is to be made the horizontal-cut blade 28 is removed and replaced with a different saw blade 48, which is attached to the rotor 33. The saw blade 48 has a disc-shaped center 65, but a frustoconical cutting periphery 67, as illustrated, for example, in FIG. 9. The angle between the circular center 65 and the frustoconical cutting periphery 67 can vary, but is preferably an obtuse angle of about one hundred sixty-eight degrees when the manhole cover frame 10 is designed to accommodate a forty-five inch diameter manhole cover. If the manhole cover frame 10 is larger and is designed to seat a fifty inch manhole cover, the obtuse angle between the circular center 65 and the frustoconical periphery 67 of the vertical-cut saw 48 should be about one hundred seventy-one degrees. To remove smaller manhole covers the obtuse angle between the central portion 65 and frustoconical periphery 67 of the blade 48 is reduced. The motor mount 35 is adjusted in angular orientation and the motor mount latch pin 41 is engaged to releasably lock the motor housing 32 at an alignment so that the lower edge of the cutting periphery 67 of the blade 48 is perpendicular to the upper surface of the pavement 11.

Depending upon the size of the manhole cover frame 10, it is advisable for the saw arm hinge 20 to be adjustably mounted on the saw mounting framework 12 to vary the distance of the saw arm hinge axis 21 from the vertical axis of alignment 13. This adjustment may be achieved by providing the saw mounting framework 12 with the U-shaped bracket 18 having horizontal, mutually parallel arms projecting inwardly from one of the short ends of the rectangular frame 14 toward the ring-shaped base 38. The saw arm orientation hinge 20 has a horizontally projecting saw arm hinge axle rod that projects through a selected set of horizontally spaced apertures 19 in the saw mounting arm bracket 18 and extends through the transverse, horizontal hinge axle opening in the base of the saw mounting arm 22. The selection of the set of apertures 19 at which the saw arm orientation hinge 20 is located varies the distance of the saw arm hinge axis 21 from the vertical axis of alignment 13.

FIGS. 1-5 and 9 illustrate the method with which the manhole cover frame removal apparatus 15 is used to free an annular manhole cover frame 10 from pavement 11 in which the manhole cover frame 10 is embedded. The manhole cover frame 10 is set in the pavement 11 in a horizontal disposition and has a vertical axis of alignment 13.

The manhole cover frame removing apparatus 15 is first rigidly secured to the manhole cover frame 10 using the anchoring fasteners 144 as shown in FIG. 6. The method is comprised of the step of cutting a horizontal groove 73, as illustrated in FIGS. 2 and 6, radially outwardly from the vertical axis of alignment 13 into the pavement 11 beneath the entire outer circumference of the manhole cover frame 10, as shown in FIG. 6. The step of cutting the radial groove 73 is performed by lowering the mounting arm 22 to the collapsed condition illustrated in FIGS. 1, 2, and 3 to cut the radial groove radially outwardly relative to the axis of alignment 13 into the pavement 11. This step is performed using a single saw secured to the saw mounting arm 22, which in turn is indirectly coupled to the manhole cover frame 10. With the saw mounting arm 22 collapsed down upon the saw mounting frame 12, the horizontal-cut saw blade 28 is mounted on the saw rotor 33. The saw is operated to saw the horizontal, radial groove 73 into the pavement directly beneath the manhole cover frame 10 to be removed. This is accomplished by advancing the saw mounting framework 12 in a complete circle atop the ring-shaped base 32 while the rotor 33 drives the saw blade 28.

Thereafter, the method of the invention involves cutting a circular groove 77 downwardly into the pavement 11 from the upper surface thereof to a depth intersecting the radial groove 73, as illustrated in FIG. 6. The circular groove 77 is cut about the entire circumference of the manhole cover frame 10.

To cut the circular groove 77 the saw mounting arm 22 is raised to the vertical upright position shown in FIGS. 4, 5, and 9 and the circular, horizontal-cut saw blade 28 is replaced with the vertical-cut saw blade 48 having a frustoconical periphery 67. The saw motor is oriented as shown in FIG. 9 with the rotor 33 facing the axis of alignment 13 at a downward inclination. The blade 48 is oriented so that the frustoconical periphery thereof diverges from the rotor 33. The vertical-cut saw blade 48 creates a vertical, circular groove in the pavement about the outer periphery of the manhole cover frame 10 as the saw mounting framework 12 is again advanced through a complete circle atop the ring-shaped base 38. As seen in FIG. 6, the annular manhole cover frame 10 is thereby completely freed from the pavement 11 and may be lifted vertically and removed.

The complete process of removal of the manhole cover 10 from the pavement 11 may be described as follows. Prior to positioning the manhole cover frame removal apparatus 15, four apertures 145 are drilled into the manhole cover frame 10 at angularly spaced intervals ninety degrees apart from each other, once the manhole cover has been removed therefrom, as illustrated in FIG. 1. The manhole cover frame removal apparatus 15 is then brought into position directly above the manhole cover frame 10. The manhole cover frame removal apparatus 15 may be brought into position as illustrated in FIG. 1 by means of a conventional three-legged wheeled manhole cover lifter with hooks supporting the saw mounting framework 12 from beneath at accessible locations thereon. The manhole cover frame removal apparatus 15 is manipulated so that the openings through the flanges 142 of the anchoring plates 40 depending from the underside of the ring-shaped base 38 are aligned with the openings 145 drilled into the manhole cover frame 10.

The manhole cover frame removal apparatus 15 is then lowered down onto the manhole cover frame 10 from the elevated position indicated in FIG. 1, to the position in which it is shown in FIG. 2, resting atop the manhole cover frame 10. The anchor fasteners 144 are then inserted into the apertures formed through the anchoring flanges 142 and into the drilled apertures 145 in the manhole cover frame 10. The manhole cover frame removal apparatus 15 is thereupon firmly secured and anchored to the manhole cover frame 10.

With the circular horizontal-cut saw blade 28 attached to the rotor 33 of the motor 30, and with the saw mounting arm support 43 collapsed as illustrated in FIG. 1, the carriage position control handwheel 26 is operated so that the carriage 24 is sufficiently distant from the saw arm mounting bracket 18 so that the saw blade 28 can clear the manhole cover frame 10 and enter the cavity of the manhole 81. With the saw mounting arm support 42 in the collapsed condition illustrated in FIGS. 2 and 3, the hand wheel 26 is operated to drive the carriage pinion 25 from a location remote from the saw mounting arm mounting bracket 18 radially outwardly from the vertical axis of alignment 13 toward the wall 79 of the manhole 81. The motor 30 is then started by opening the hydraulic valve 46 to admit the driving hydraulic fluid from the inlet line 61 into the motor 30 to drive the rotor 33 in rotation. The carriage position control handwheel 26 is then counterrotated to advance the carriage 24 toward the saw mounting arm bracket 18 with the motor mount 35 releasably locked relative to the carriage 24 by means of the motor locking pin 41. The rotor 33 is driven about its axis of rotation 63, which is then vertical and parallel to the vertical axis of orientation 13 of the manhole cover frame 10.

The carriage position control handwheel 26 is rotated so that the cutting edge of the circular blade 28 bites into the pavement 11 beneath the lower extremity of the annular manhole cover frame 10. The carriage 24 is moved toward the saw arm mounting bracket 18 until the rotating circular blade 28 bites deep enough into the pavement 11 so that the horizontal groove 73 thereby created extends radially beyond the outer peripheral edge of the annular manhole cover frame 10.

With the rotating saw blade 28 biting into the pavement 11 beneath the manhole cover frame 10, the saw mounting framework 12 is advanced in a circular path about the vertical axis of alignment 13 by driving the framework advancement pinion 45 so as to travel entirely around the ring gear 47 in a three hundred sixty degree circuit, as viewed in FIG. 3. Once the saw mounting framework 12 has traversed a complete circuit about the axis of alignment 13, the horizontally oriented, radially extending, annular groove 73 will be formed about the entire annular area beneath the manhole cover frame 10. If the groove 73 cannot be cut this deeply in a single pass, the carriage 24 can be advanced incrementally toward the saw arm mounting bracket 18 following each circular rotation of the saw mounting framework 12 in a complete three hundred sixty degree rotation about the ring-shaped base 38.

Once the horizontal groove 73 has been formed, the hydraulic fluid valve 46 is closed to stop the motor 30 and the saw mounting arm 22 is raised from the collapsed, horizontal orientation shown in FIGS. 2 and 3, to the vertical, upright orientation shown in FIGS. 4, 5, and 9. As the saw mounting arm 22 is raised, the mounting arm supporting links 42 and 44 are also raised from their collapsed condition alongside each other to an extended condition, as shown in FIGS. 4, 5, and 9. The latch pin 161 is then inserted through the openings 156 and 158 in the hinge plates 153 and 152, respectively, since those openings are coaxially aligned with each other when the saw mounting arm 22 is vertically upright. Once the latching pin 161 is inserted, the saw arm mounting support 43 is locked to hold the saw mounting arm 22 vertically upright.

The saw blade 28 is then removed from the rotor 33 and replaced with the vertical-cut saw 48, which has a frustoconical cutting periphery 67. The blade 48 is mounted to the rotor 33 with the frustoconical cutting periphery 67 diverging from the rotor 33. The motor mount latching pin 41 is then withdrawn to realign the rotor axis 63 to an inclined orientation whereby the cutting edge of the cutting periphery 67 of the vertical cutting blade 48 is aligned perpendicular to the surface of the pavement 11, as illustrated in FIGS. 5 and 9. The angular orientation of the motor mount 35 relative to the saw mounting arm 22 is determined by the angle of the frustoconical cutting periphery 67 relative to the central circular portion 65 of the vertical-cut saw blade 48. Different bores are defined in the surface 37 of the carriage 24 to receive the motor mount locking pin 41 for each of the standard manhole cover sizes, since each different manhole cover size will require a vertical-cut saw blade 48 having a slightly different shape.

Once the motor mount locking pin 41 has been engaged with the selected bore in the carriage 37, the valve 46 is opened to operate the motor 30. The carriage position control handwheel 26 is rotated to move the carriage 24 vertically downwardly, toward the mounting bracket 18. The carriage 24 is advanced until the cutting periphery 67 of the vertical-cut saw blade 48 bites into the upper surface of the pavement 11, excavating a vertical groove 77 to a suitable depth to intersect the horizontal groove 73.

The framework advancement handwheel 36 is then manually operated to advance the framework 12 in rotation about the entire circumference of the manhole cover frame 10. A circular vertical groove 77 is thereby formed about the entire outer perimeter of the radial outboard extremity of the manhole cover frame 10.

In this connection it is important to note that, due to the frustoconical shape of the cutting periphery 67 of the vertical-cut saw blade 48, the portion of the frustoconical cutting periphery that extends below the upper surface of the pavement 11 creates an arcuate cut, rather than a straight cut such as would occur if the saw blade used were simply a circular saw blade. By rotating the saw mounting framework 12 in a complete circle atop the ring-shaped base 38, this arcuate cut is extended throughout the entire three hundred sixty degrees circumference of the manhole cover frame 10.

Once the circular, vertical groove 77 has been completed so as to intersect the horizontal groove 73 completely about the periphery of the manhole cover frame 10, it is possible to lift the manhole cover frame 10, together with the small amount of pavement material located above the horizontal groove 73 and within the circumference of the vertical groove 77, vertically up above the surface of the pavement 11. A conventional lifter wheeler hydraulically lifts the old manhole cover frame 10 vertically upwardly and moves it out of position.

The lifter wheeler is a conventional device formed of a framework having a generally trapezoidal shape, open on one side. Four legs extend vertically downwardly at the corners of the framework. Each leg terminates in a large wheel or caster. A generally L-shaped lifting lever is mounted on the narrow side of the lifter wheeler and engages a generally triangular tri-leg grapple frame. The lifter wheeler is moved into position to straddle the circular groove 77 defined about the perimeter of the manhole cover frame 10.

The lifting lever arm on the lifter wheeler is thereupon located at approximately the central axis of alignment 13. The tri-leg lifter has three legs spaced one hundred twenty degrees apart, each bearing a hook directed radially outwardly. The hooks of the tri-leg lifter are moved in an outboard direction to engage the manhole cover frame 10 by insertion into the horizontal groove 73. The lever arm on the lifter wheeler is then pushed downwardly, thereby raising the manhole cover frame 10 along with the tri-leg lifter. The lifter wheeler is then rolled across the surface of the pavement 11, away from the manhole 18, to move the old manhole cover frame 10 out of the way.

A clean, stepped, annular recessed cavity in the pavement 11 is thereby left. Once any necessary road work has been performed, a new manhole cover, which may be part of a lockable system or which have waterproof features, can be lowered into the annular cavity left in the surface of the pavement 11 by the removal of the old manhole cover frame 10. The new manhole cover frame can be glued in place by an epoxy or polyurea fast setting glue.

Undoubtedly, numerous variations and modifications of the invention will become readily apparent to those familiar with the installation and removal of manhole cover frames. For example, there are numerous different types of saw mounting arm supports that could be employed. One alternative arrangement to the articulated saw mounting support 43 is a simple fixed length or telescopic support having a foot that can be alternatively engaged or disengaged with the saw mounting framework Numerous other variations and modifications of the invention are also possible. Accordingly, the scope of the invention should not be construed as limited to the specific embodiment depicted and the implementation of the method described, but rather is defined in the claims appended hereto.

I claim:

1. An apparatus for freeing an angular manhole cover frame having a vertical axis of alignment embedded in pavement from said pavement comprising:

a ring-shaped base with at least one circular track defined thereon about its entire circumference;

a plurality of releaseable anchoring fasteners located at intervals about the circumference of said base and which immobilize said base relative to said manhole cover frame so that said base is supported atop said manhole cover frame in coaxial alignment therewith;

a saw mounting framework disposed atop said ring-shaped base and having a plurality of track followers that engage said track, whereby said saw mounting framework is movable in rotation about said vertical axis of alignment of said manhole cover frame;

a saw mounting arm joined to said saw mounting framework by a saw arm orientation hinge having a horizontal saw arm hinge axis;

a saw arm locking mechanism for locking said saw mounting arm relative to said saw mounting framework in a vertical orientation relative thereto;

a saw carriage mounted on said saw arm for reciprocal movement toward and away from said saw arm hinge axis;

a saw motor having a saw motor housing and a saw blade rotor mounted for rotation about a saw rotor axis relative to said saw motor housing;

a releaseable saw motor lock for immobilizing said saw motor housing relative to said saw carriage at alternative selected angles of orientation of said saw rotor axis relative to said saw mounting arm; and separate horizontal-cut and vertical-cut saw blades alternatively and interchangeably attached to said saw blade rotor.

2. An apparatus according to claim 1 wherein said ring-shaped base defines both a radially inwardly facing circular inner track and a radially outwardly facing circular outer track and said saw mounting framework is provided a plurality of sets of inner and outer track rollers that respectively engage and follow said inner and outer tracks in rolling engagement therewith.

3. An apparatus according to claim 2 wherein a ring gear coaxial with said ring-shaped base is formed about the entire perimeter of said ring-shaped base and further comprising a framework advancement pinion journeled to said saw mounting framework for rotation about a vertical axis, and a framework drive mechanism for rotating said framework advancement pinion to advance said framework for rotation about said vertical axis of alignment throughout the circumference of said base.

4. An apparatus according to claim 3 wherein said framework drive mechanism is comprised of a manually operated framework advancement handwheel coupled to said framework advancement pinion.

5. An apparatus according to claim 1 wherein said ring-shaped base is provided with a plurality of anchoring flanges located at intervals about the circumference of said base and depending therefrom and oriented to face said annular manhole cover frame and said anchoring fasteners pass through said anchoring flanges and are engaged in said manhole cover frame.

6. An apparatus according to claim 1 further comprising a pair of saw mounting arm supporting links both having first ends hinged to each other and second ends, one of which is hinged to said saw mounting framework and the other of which is hinged to said saw mounting arm remote from said saw arm orientation hinge, and said saw mounting arm supporting links are movable in rotation about horizontal axes relative to each other and relative to said saw mounting framework and said saw mounting arm, whereby said saw mounting arm supporting links are collapsible alongside each other when said saw mounting arm is in a horizontal orientation and extended from each other when said saw mounting arm is in a vertical orientation.

7. An apparatus according to claim 6 wherein said saw arm locking mechanism is comprised of support link hinge elements located at each of said first ends of said saw mounting arm supporting links and each support link hinge element has at least one supporting link latch pin opening therethrough, and a supporting link latch pin engageable in said supporting link latch pin openings to immobilize said saw mounting arm supporting links relative to each other when said saw mounting arm is in said vertical orientation.

8. An apparatus according to claim 1 wherein a toothed rack is formed on said saw mounting arm and said saw carriage is equipped with a carriage pinion and a carriage pinion drive mechanism, whereby said saw carriage is engaged by rack and pinion gearing in its reciprocal movement along said saw mounting arm.

9. An apparatus according to claim 8 wherein said carriage pinion drive mechanism is comprised of a manually operated carriage position control handwheel coupled to said carriage pinion.

10. An apparatus according to claim 1 wherein said saw arm orientation hinge is adjustably mounted on said saw mounting framework to vary the distance of said saw arm hinge axis from said vertical axis of alignment.

11. An apparatus according to claim 1 wherein said horizontal-cut saw blade has a circular shape and said vertical-cut saw blade has a frustoconical cutting periphery.

12. An apparatus according to claim 11 wherein said vertical-cut saw blade is mounted upon said saw blade rotor so that said frustoconical cutting periphery thereof diverges away from said saw blade rotor.

* * * * *